United States Patent [19]

Mann

[11] Patent Number: 4,830,243

[45] Date of Patent: May 16, 1989

[54] DETACHABLE TRAY

[76] Inventor: Kenneth R. Mann, 7112 S. Villanova Dr., St. Louis, Mo. 63123

[21] Appl. No.: 94,270

[22] Filed: Sep. 8, 1987

[51] Int. Cl.[4] ..... A61H 3/00

[52] U.S. Cl. ..... 224/42.44; 224/273; 135/65; 108/44; 108/88; 297/DIG. 4

[58] Field of Search ..... 224/273, 42.42, 42.43, 224/42.44; 135/65, 66, 67; 108/44, 43, 46, 126, 88, 134, 135; 297/DIG. 4

[56] References Cited

U.S. PATENT DOCUMENTS

| | | | |
|---|---|---|---|
| 2,430,235 | 11/1947 | Mendenhall | 135/67 |
| 2,898,170 | 8/1959 | Antonius | 224/42.44 X |
| 2,961,279 | 11/1960 | Kjellstrom | 108/46 X |
| 3,386,392 | 6/1968 | Gramm | 108/44 |
| 3,957,071 | 5/1976 | Kenner | 135/67 X |
| 3,999,798 | 12/1976 | Roulier | 297/DIG. 4 X |
| 4,339,063 | 7/1982 | Trubiano | 224/273 |
| 4,357,881 | 11/1982 | DeLong | 211/88 |
| 4,373,756 | 2/1983 | Purdy et al. | 297/DIG. 4 X |
| 4,403,786 | 9/1983 | Ulics | 224/273 X |
| 4,449,750 | 5/1984 | Pultman | 224/273 X |
| 4,491,257 | 1/1985 | Ingles | 224/273 X |
| 4,566,732 | 1/1986 | Ostergaard, II et al. | 297/DIG. 4 X |
| 4,577,788 | 3/1986 | Richardson | 224/273 |
| 4,659,099 | 4/1987 | Malone | 108/44 X |
| 4,705,287 | 11/1987 | Cumbie | 297/DIG. 4 X |
| 4,708,274 | 11/1987 | Roche | 224/42.43 X |

*Primary Examiner*—Henry J. Recla

[57] ABSTRACT

The apparatus is attachable and detachable to walkers via rotating spring clips attached to the rails or legs of walkers. It is stable, attached at three points, yet variable in height and angle of surface by use of the telescopic brace, rotating clips and sliding brace attached to the tray angle by wing nuts and bolts. It is usable and storable and out of the walker user's way via the rotating attachment clips and telescopic brace. It does not rust not corrode and is cleanable with soap and water. The sliding of the brace horizontally in the angle, the telescopic variable height and tray angle, the angles of bends of the brace ends, and fully rotating attachment clips allow the apparatus to be assembled, attached and detached to multiple designs of walkers. The variable angle of the tray surface provides a writing surface while the apparatus is attached. The tray is countersunk and usable while attached for carrying items. Without the use of tools, the apparatus is assembled, attached or detached to walkers. The entire apparatus, when attached, fits inside the exterior side-to-side dimensions of the walker and does not interfere with the user nor use of the walker during movement or while stationary.

3 Claims, 1 Drawing Sheet

DETACHABLE TRAY

BACKGROUND OF THE INVENTION

The field of this is an apparatus to assist walker users in carrying items and it provides a variable height and angle writing surface.

BACKGROUND ART

This invention solves the problems of use with walkers by; providing easy attachment/detachment to multiple models of walkers, does not interfere with the user or use of walkers, provides a stable and multi-height and angle writing surface and carrying tray, it is rust and corrosion free, it is easily cleaned with soap and water, it is storable out-of-the-way while attached to the walker, and it is assembled and attached/detached without the use of tools with minimum strength required.

SUMMARY OF THE INVENTION

This invention may be used with multiple models of walkers. The design using three points of attachment with rotating spring clips and a telescopic brace that slides horizontally in angle attached to the tray allows the invention to be attached to a walker rail and two legs, two walker rails, or a walker rail and one leg. The telescoping brace that is horizontally positionable and rotating clips will accommodate variable distance between multiple walker models rails and legs. Thus, this convenient writing surface and carrying tray will fit multiple models of walkers.

This invention attaches in front of the walker and since most walker users stand between the rails, behind or beside their walker, the three-point attachment in the front does not interfere with the walker use or user.

This invention, having a three-point attachment with the telescopic brace attached to the horizontal angle provides a multi-height and multi-angle but stable writing and carrying surface. The features allow the invention to be folded down flat against the front of the walker providing convenient storage while the invention is attached.

The invention, constructed of plastic or aluminum is lightweight (a little over one pound), rust and corrosion free, cleanable with soap and water, needs no lubrication, and is stable as it will support over twelve (12) pounds.

The component parts are all designed and arranged for "finger tip" use. Such items as countersunk screws, wing nuts, and spring clips make "no tools for assembly" possible and with minimum strength required.

DESCRIPTION OF THE DRAWINGS

Figure 1:
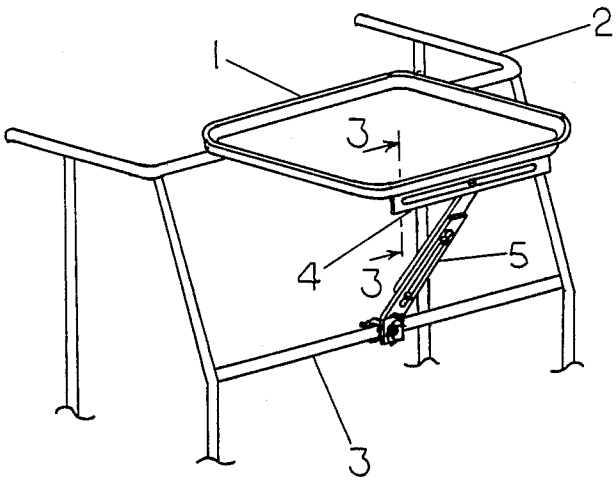
FIG. 1 is a perspective view from above and in front of the invention showing it attached to a walker.

In FIG. 1 a device regarded as a walker is shown in part. This is 2 and 3 in FIG. 1. The walker constitutes no part of this invention. This type of walker is used for illustrative purposes only for display of the invention. Because of the telescopic, horizontal mobility, and rotational features of the brace 5, the invention may be used with other models of walkers. (See detail description of FIG. 4.) Thus as shown in FIG. 1 the invention is attached to the front of the walker. When the use of the walker enters the rear of the walker between the horizontal bar(s) 2 the invention is attached to the front of the walker not being inside the horizontal U-shape space formed by the horizontal bars 2 which are generally grasped by the user for support and assistance during mobility. Thus the invention in FIG. 1 is the tray 1, including attachment device which are minor detachment stowage clips 7, the angle 4 as attached to the tray 1, the brace 5, including telescoping/rotation/ attachment features.

Figure 2:
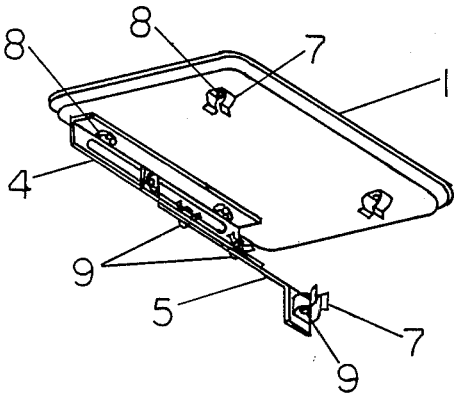
FIG. 2 is a perspective view of the invention from below and behind showing it detached from a walker.

FIG. 2 presents the invention detached from a walker and essentially shows the elements of this Detachment Writing Surface and Tray for Walkers invention. As shown in FIG. 2 the assembled parts of the invention are the tray 1, the mounting angle 4, the brace 5, the stowage clips 7, the wing nuts 8, and slotted flat head screws 9. The invention is shown constructed of aluminum. It is flat bottomed, the edges beveled upward from the bottom causing a tray depth of ¾". The edges are beveled up from the bottom at an angle of 45° for a distance ¾" outward from the tray bottom to a rounded non-sharp exterior edge of the tray. The overall dimensions of the tray may vary but are shown as 13 15/16" long by 10 13/16" wide. The tray 1 includes four (4) countersunk holes which are placed in the tray 1 and used to attach the minor diameter stowage clips 7 and mounting angle 4 with wing nuts 8 and slotted flat-head screws 9. The countersunk holes are placed in the tray 1 in such a way to keep the heads of the screws 9 flush to the bottom of the tray 1.

Figure 4:
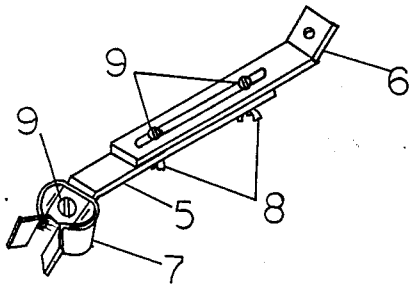
FIG. 4 is a detail perspective view from above of the brace portion of the invention and said brace is item 5 in FIG. 1. This view shows the telescopic, attachment, and rotation features of the brace.

FIG. 2 demonstrates the brace 5 attached to the mounting angle 4. FIG. 4 details the brace 5. Thus FIG. 1 demonstrates the fully assembled invention (FIG. 2) including the brace 5 detailed in FIG. 4 attached to mounting angle 4. The fully assembled invention is attached to a walker as demonstrated in FIG. 1.

The mounting angle 4 in FIG. 2, non-slotted side, is attached to the bottom of the tray 1 by using the wing nuts 8 placed on the slotted flat-head screws 9 with the screw 9 heads flush with the bottom of the tray 1 and the screw 9 threads through the bottom of the tray 1 and through the holes in the mounting angle 4 non-slotted side to receive the wing nuts 8 for attachment of the mounting angle 4 to the tray 1. The holes in the base side (non-slotted) of the angle 4 are placed at exactly the location needed to match the countersunk holes (previously mentioned) in the tray 1. The holes in the mounting angle 4 are centered inside each exterior end of the length of the mounting angle 4. The 7/32" diameter holes are ½" inside the width edge of the mounting angle 4 measuring from the edge of the mounting angle 4 away from the slotted side of the mounting angle 4. The corners of the non-slotted side of the mounting angle 4 are not rounded. The mounting angle 4 when attached to the tray 1 does not protrude from the tray 1 thus eliminating hazard to the user or other persons or things nearby in the use area. The slotted side of the mounting angle 4 has rounded corners. This feature also eliminates possible hazards.

As demonstrated in FIG. 1 and FIG. 2, the brace 5 detailed in FIG. 4, is attached at one end to the mounting angle 4 and at the other end to the walker rail or leg via use of the minor diameter stowage clip 7 which is attached to the end of the brace 5 as shown in FIG. 4.

Figure 5:
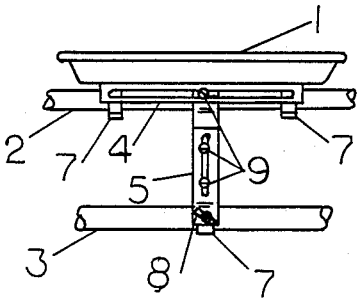
FIG. 5 is a cross-sectional front view of the invention while it is attached to a walker taken on line 3—3 of FIG. 1.

As detailed in FIG. 5 the slotted mounting angle 4 allows attachment of the brace 5 using slotted flat-head screws 9 and wing nuts 8. This slotted attachment angle 4 allows the special feature of horizontal movement of the brace 5 to an attachment point presenting the greatest support stability for the tray 1 and allowing the other end of the brace 5 to be attached to variable heights or spaced walker rails or even walker legs or slanted braces on the variable designed walkers. This slotted mounting angle 4 allowing wide horizontal movement of the tray 1 attachment point for the brace 5 adds flexibility and stability features.

The brace 5 detailed in FIG. 4 is a two (2) piece device with each piece slotted and one end of each piece bent at a 45° angle. The two (2) non-bent ends are placed together with the bent ends pointed in opposite directions and by using two (2) slotted flat-head screws 9 and two (2) wing nuts 8 placed through the slots of the pieces while the pieces are placed on top of each other (see FIG. 4) the device becomes a stable brace 5 when the wing nuts 8 are tightened while allowing lengthening or shortening (telescopic) of the brace 5 as needed. One of the pieces of the brace 5 has a minor diameter stowage clip 7 attached to the bent angle and which has a receiving hole used to attach the minor diameter stowage clip 7 via the slotted flat-head screw 9 and wing nut 8. This "clip" end of the brace 5 is attached to the walker rail, slanted brace, or leg as demonstrated in FIG. 1. The other piece of the brace 5 having the bent end 6 as demonstrated in FIG. 4 is attached to the mounting angle 4 as shown in FIG. 1, FIG. 2, and FIG. 5. The brace 5 is attached to the mounting angle 4 by using a slotted flat head screw 9 and a wing nut 8. The mounting angle 4 is attached rigidly to the tray 1 as previously detailed and as demonstrated in FIG. 2.

The brace 5, when assembled and attached to the mounting angle 4 and with the fully rotatable minor diameter stowage clip 7 attached, features variable horizontal and rotational movement, variable vertical movement, telescopic lengthening and shortening, easy attachment and detachment from the walker and provides excellent positioning stability for the tray 1 while allowing much flexibility in attachment needs for variable walker models and varied uses on those walkers. For ease of use and storage, these rotational, vertical, horizontal, and telescopic features allow the brace 5 to be folded flush with the bottom of the tray 1 for storage flat against the front legs of a walker while the invention remains attached or the brace 5 may be folded flush to the bottom of the tray 1 while the invention is detached from a walker.

FIG. 5 shows a frontal view of the assembled invention attached to a walker. Thus FIG. 5 clearly shows the absence of hazards such as sharp edges, screw threads, nuts, clips or other protrusions. It also shows the simplicity of design and stability of the invention.

Figure 3:
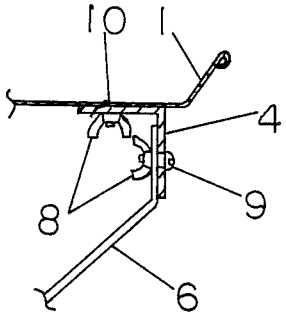
FIG. 3 is a cross-sectional side view of the invention while detached from a walker taken on line 3—3 of FIG. 1.

FIG. 3 shows a cross-sectional side view of the invention which is intentionally enlarged compared to the other figures to clearly show clearances between the wing nuts 8, the side of the tray 1, the bent angle 6, of the brace 5, and the mounting angle 4 as all of these relate to the base 10 of the tray 1.

PREFERRED EMBODIMENTS

The preferred use of this invention provides an easy to use, detachable/attachable, easily stored, easily cleaned, multi-movement, multi-angle and height, durable, stable, virtually hazard free and inexpensive apparatus that can be assembled and attached to walkers without tools which will allow the walker user freedom to carry articles and provides a variable angle and height writing surface.

I claim:

1. A unique assembly of component parts; countersunk tray, horizontal angle attached to tray, via countersunk screws and wing nuts, two part telescopic brace each part angled at 45 degrees on one end and flat on the other and both parts slotted with the parts attached in the middle with two wing nuts and bolts and attached to the tray angle on one end and to a fully rotating spring clip on the other end, and two spring clips attached via countersunk screws and wing nuts to the bottom of the tray when fully assembled provides a three-point attachment of the invention to a walker.

2. An apparatus when assembled in accordance with the claim 1 will attach to or detach from multiple models of walkers providing both a variable angle writing surface and tray for carrying items which does not interfere with the user or use of a walker.

3. An apparatus in accordance with claim 2 that may be assembled, attached, or detached from said walker without the use of tools.

* * * * *